US005752444A

United States Patent [19]

Lorig

[11] Patent Number: 5,752,444

[45] Date of Patent: May 19, 1998

[54] SEAMLESS PRINTING SLEEVE AND METHOD OF MANUFACTURE THEREOF

[75] Inventor: Heinz-W. Lorig, Legden, Germany

[73] Assignee: Polywest Kunststofftechnik, Sauerssig & Partner GmbH & Co. KG, Ahaus, Germany

[21] Appl. No.: 679,370

[22] Filed: Jul. 10, 1996

[30] Foreign Application Priority Data

Jul. 10, 1995 [DE] Germany ..... 195 24 707.8

[51] Int. Cl.[6] ..... B41F 13/10; B41F 27/00

[52] U.S. Cl. ..... 101/375; 29/895.23; 492/48; 492/56; 492/18

[58] Field of Search ..... 101/216, 217, 101/375, 376, 395, 401.1; 492/4, 18, 48, 56; 29/895.23, 895.3

[56] References Cited

U.S. PATENT DOCUMENTS

| | | | |
|---|---|---|---|
| 3,982,312 | 9/1976 | Finzer | 492/48 |
| 4,378,622 | 4/1983 | Pinkston et al. | 492/56 |
| 4,583,460 | 4/1986 | Maslin et al. | 101/375 |
| 4,641,411 | 2/1987 | Meulen | 101/375 |
| 4,864,926 | 9/1989 | Saueressig | 101/378 |
| 4,903,597 | 2/1990 | Hoage et al. | 101/375 |
| 5,072,504 | 12/1991 | Thompson | 29/895.23 |
| 5,216,954 | 6/1993 | Thompson | 101/375 |
| 5,537,923 | 7/1996 | Boor et al. | 101/375 |
| 5,544,584 | 8/1996 | Thompson et al. | 101/375 |
| 5,577,443 | 11/1996 | Songer | 101/375 |

FOREIGN PATENT DOCUMENTS

| | | | |
|---|---|---|---|
| 2027200 | 1/1979 | Germany | 101/375 |

*Primary Examiner*—Stephen R. Funk
*Attorney, Agent, or Firm*—Hill, Steadman & Simpson

[57] ABSTRACT

The invention relates to a printing sleeve and a method for producing a seamless printing sleeve particularly for a flexo printing cylinder with the printing sleeve being slidable onto a core roll when flexibly expanded by means of a pressurized air cushion and being slidable off therefrom. One method according to the present invention includes the following steps:

forming a hollow cylindrical inner sleeve of plastic material with one or more layers with the inner diameter of the inner sleeve being slightly smaller than the outer diameter of the associated core roll;

forming a hollow cylindrical outer sleeve of plastic material with one or more layers with the inner diameter thereof slightly smaller than the outer diameter of the inner sleeve;

applying a rubber layer to the outer sleeve at the outer circumference thereof;

sliding the outer sleeve onto the inner sleeve and while temporarily flexibly expanding the inner diameter of the outer sleeve, and securing the outer sleeve to the inner sleeve by frictional engagement;

machining the rubber layer at the outer side thereof, particularly by grinding for a cylindrical circumference; and engraving the outer surface of the rubber layer.

24 Claims, 1 Drawing Sheet

SEAMLESS PRINTING SLEEVE AND METHOD OF MANUFACTURE THEREOF

BACKGROUND OF THE INVENTION

The invention relates to an improved seamless printing sleeve and a method for producing a seamless printing sleeve. More particularly, the invention relates to a seamless printing sleeve for a flexographic ("flexo") printing cylinder, with the printing sleeve being slidable onto a core roll when flexibly expanded by means of a pressurized fluid or air cushion, and in the same way being slidable off therefrom.

Printing sleeves for flexographic ("flexo") printing cylinders and methods for the production thereof have been known for years. Such printing sleeves on the one hand offer the advantage of being substantially lighter than solid metallic printing cylinders. Further, by using a flexo printing cylinder with a printing sleeve, many different printing lengths may be covered by producing printing sleeves with various outer diameters but with the same inner diameter for fitting onto a core roll. Therefore, a plurality of printing circumferences can be provided with a minimal number of core rolls.

A plurality of printing sleeves of different sizes for a single core roll can be provided by producing the outer rubber layer of the printing sleeves in different thicknesses. However, this solution is limited because the rubber layer flexes more during the printing process as the thickness of the rubber layer is increased. This leads to changes in the reference circle, difficulties in keeping the register and, consequently, printing errors. Thus, there is an upper limit to the printing circumference of the flexible printing sleeve.

The best printing qualities have been achieved with relatively small thicknesses of the rubber layer of only 3 to 5 mm. However, these small thicknesses do not achieve the object of providing a wide variety of printing circumferences for each flexo printing cylinder.

On the other hand it is known from the technology of cliche or printing block sleeves to produce printing sleeves with a large range of variance of the material thickness. Round bent cliches, e.g. in the form of photopolymer printing plates, are glued onto these sleeves. These sleeves have several layers in order to enable the large range of variance for the material thickness achieve the required stability without the weight of the sleeves becoming too large.

Given the objective of producing rubber printing sleeves with a wider range of outer circumferences and thereby many different printing circumferences, one could develop the idea of a layered printing sleeve for a flexo printing cylinder that is not glued to the cylinder. However, this solution cannot be attained for practical reasons. Specifically, the rubber layer can only be attached while using relatively high temperatures and pressures. Normally, these temperatures and pressures are produced in an autoclave. When using the printing sleeves known from the technology of cliche sleeves described above, then the problem would arise that the material of the sleeves or at least parts of the material of the sleeves would not withstand these high temperatures and pressures. Therefore this solution is excluded for practical reasons.

SUMMARY OF THE INVENTION

It is therefore an object of the present invention to provide a method for the production of a seamless printing sleeve, particularly for flexo printing cylinders, wherein the drawbacks described before are avoided, and which enables the production of printing sleeves which cover a very large range of different printing circumferences while using only very few different core rolls.

According to the invention the above objects are attained by a method comprising the following steps:

- forming a hollow cylindrical inner sleeve of plastic material with one or more layers with the inner diameter of the inner sleeve slightly smaller than the outer diameter of the associated core roll, with which later the printing sleeve forms the flexo printing cylinder,
- forming a hollow cylindrical outer sleeve of plastic material, apart from the inner sleeve, with one or more layers with the inner diameter thereof slightly smaller than the outer diameter of the inner sleeve,
- coating the outer sleeve at the outer circumference thereof with a rubber layer,
- forming the printing sleeve with the outer sleeve and the inner sleeve by slidingly fitting the outer sleeve and inner sleeve into each other while temporarily flexibly expanding the inner diameter of the outer sleeve, and securing the inner and outer sleeves together by frictional engagement,
- machining or grinding the rubber layer at the outer side thereof, and
- engraving the surface of the rubber layer.

According to the present invention, the printing sleeve is firstly produced in two separate parts and in two separate method steps. In the one method step, the inner sleeve is produced which may comprise one or more layers, and consist of plastic material which is known. Furthermore, in a second method step, the outer sleeve is produced of plastic material which also may comprise one or more layers. Only this outer sleeve is provided with a rubber layer at the outer circumference thereof, such that only the outer sleeve is exposed to the raised temperatures and pressures which are necessary for the attachment of the rubber layer.

On the other hand, the inner sleeve may be produced without any regard to temperatures and pressures necessary for the rubber layer. Therefore, there are no restrictions in relation to the stability against temperatures and/or pressures when selecting the material for the inner sleeve. The material for the two parts of the sleeve, i.e. for the inner sleeve on the one hand and the outer sleeve on the other hand, may be selected and combined in an optimal way.

After fitting the inner sleeve and the outer sleeve together, these members are secured by the differentials of the diameters mentioned and by the frictional engagement produced thereby. They are secured in relation to each other against rotation resulting in features like an integrally produced sleeve member. As the rubber layer at the outer circumference of the outer sleeve is machined only after the fitting together of the inner sleeve and the outer sleeve which results in a cylindrical outer sleeve, a cylindrical and therefore smoothly rotating sleeve is produced although the sleeve has been produced from two distinct members. Subsequently the surface of the rubber layer is engraved using known methods.

A significant advantage is that the different material thicknesses in the printing sleeve according to the invention no longer have to be attained by a variance of the thickness of the rubber layer, but rather are attained by the variance of the material thickness of the inner sleeve. Therefore, the thickness of the rubber layer may be maintained in a thickness range optimal for each specific purpose. Furthermore, the sleeve has a comparatively light weight because the inner sleeve is made of a specifically lighter material as compared with rubber. A further advantage is that when wear of the rubber layer occurs after a certain time of operation, the outer sleeve may be removed from the inner sleeve and replaced by a new outer sleeve. As the worn out outer sleeve is no longer required, it may be cut along the longitudinal direction thereof for removing it from the inner sleeve whereafter the stripping from the inner may be done without any damage to the inner sleeve and without any problem.

Preferably, the inner sleeve and the outer sleeve at least partially may be produced of fiber reinforced plastic material. This material combines a low weight and a comparatively simple machinability with a high strength and stiffness.

Furthermore, it is proposed that the inner sleeve is produced with four layers wherein the first radially inner layer is produced of high density reinforced plastic material, the second layer of a flexibly compressible plastic material, the third layer of a lower density plastic material, and the fourth radially outer layer of a particularly firm polymer of high density. The fourth layer may be designed with or without fiber reinforcement. In this way an inner sleeve is produced comprising comparatively hard surfaces having a good form stability at the inner circumference thereof and at the outer circumference thereof. The layers disposed between the inner and the outer layer may be provided with a smaller density and hardness whereby a lower total weight of the inner sleeve may be attained, particularly when the inner sleeve has a relatively high material thickness. At the same time, a slight flexible expanding of the inner diameter is possible which is required for sliding the complete printing sleeve onto the core roll with the help of an air cushion, to form a printing cylinder. Preferably a high resistance foam plastic material is used for the third layer.

It is preferably provided that also the outer sleeve is at least partially formed of fiber reinforced plastic material, whereby the advantages mentioned above may be attained also for the outer sleeve.

For simplifying the fitting together of the inner sleeve and the outer sleeve and for guaranteeing an exact rotation of the final printing sleeve and the complete printing cylinder, it is provided that the outer circumferential surface of the inner sleeve, prior to the fitting together of the inner sleeve and the outer sleeve, is cylindrically machined at the surface thereof, preferably by grinding. A surface machining of the inner circumference of the outer sleeve is not required as a rule, as preferably the outer sleeve is produced on a master core or metal mandrel with a machined outer surface. However, surface machining of the inner circumference of the inner sleeve is possible and is considered within the scope of the present invention.

In order to keep the thrust and/or tensile forces required for the fitting together of the inner sleeve and outer sleeve within tolerable limits, it is proposed that this fitting together is accomplished by means of a pressurized fluid or air cushion.

A further development of the method relating to the use of a pressurized fluid cushion proposes that prior to the fitting together of the inner sleeve and the outer sleeve, an adaptor is detachably positioned at the front face of the inner sleeve, with the outer diameter of the adaptor being equal with the outer diameter of the inner sleeve. During the fitting together of the inner sleeve and the outer sleeve, pressurized fluid or air is fed to at least one pressurized fluid discharge opening at the outer circumference of the adaptor. After the fitting together of the inner sleeve and the outer sleeve, the adaptor is removed. Advantageously, neither the inner sleeve nor the outer sleeve need to include any means for the guiding and distribution of pressurized fluid for producing a fluid cushion. The preferred pressurized fluid is air. The feeding of the air is attained only by means of the adaptor whereby the forming of the required air cushion is completely guaranteed.

Furthermore it is provided that the engraving of the surface of the rubber layer is attained by laser engraving. This is a known method as such and it is advantageously usable because it produces a fast and exact engraving.

The inner sleeve as a part of the sleeve produced using the method according to the invention may be manufactured with a thickness between about 5 mm and about 100 mm in radial direction. Hereby a very large circumferential area is to be attained, with the inner diameter remaining constant using only a single core roll. In this way, again, a reduction of the number of core rolls required for most operations is attained.

Preferably the outer sleeve is produced with a material thickness between 8 and 15 mm in radial direction including the rubber layer wherein the thickness of the rubber layer preferably is between 3 and 10 mm. The rubber layer as such is no longer used for varying the circumference of the printing sleeve produced by the method according to the invention and therefore may be kept in an optimal range for each purpose. Having a relatively large initial thickness of the rubber layer, there is the possibility that after a first engraving and after a first use this layer is ground off at the surface thereof and is again engraved and used without having to attach a new rubber layer or a new outer sleeve.

In the method of the production according to the invention there are no restrictions regarding the axial lengths of the printing sleeve, and printing sleeves of all required lengths may be manufactured.

BRIEF DESCRIPTION OF THE DRAWING

The drawing shows an exemplary embodiment produced by the method of manufacturing a seamless printing sleeve for a flexo printing cylinder, the embodiment and method being set forth in detail below. Thereby shown is.

DETAILED DESCRIPTION OF THE PREFERRED EMBODIMENTS

Figure 1:
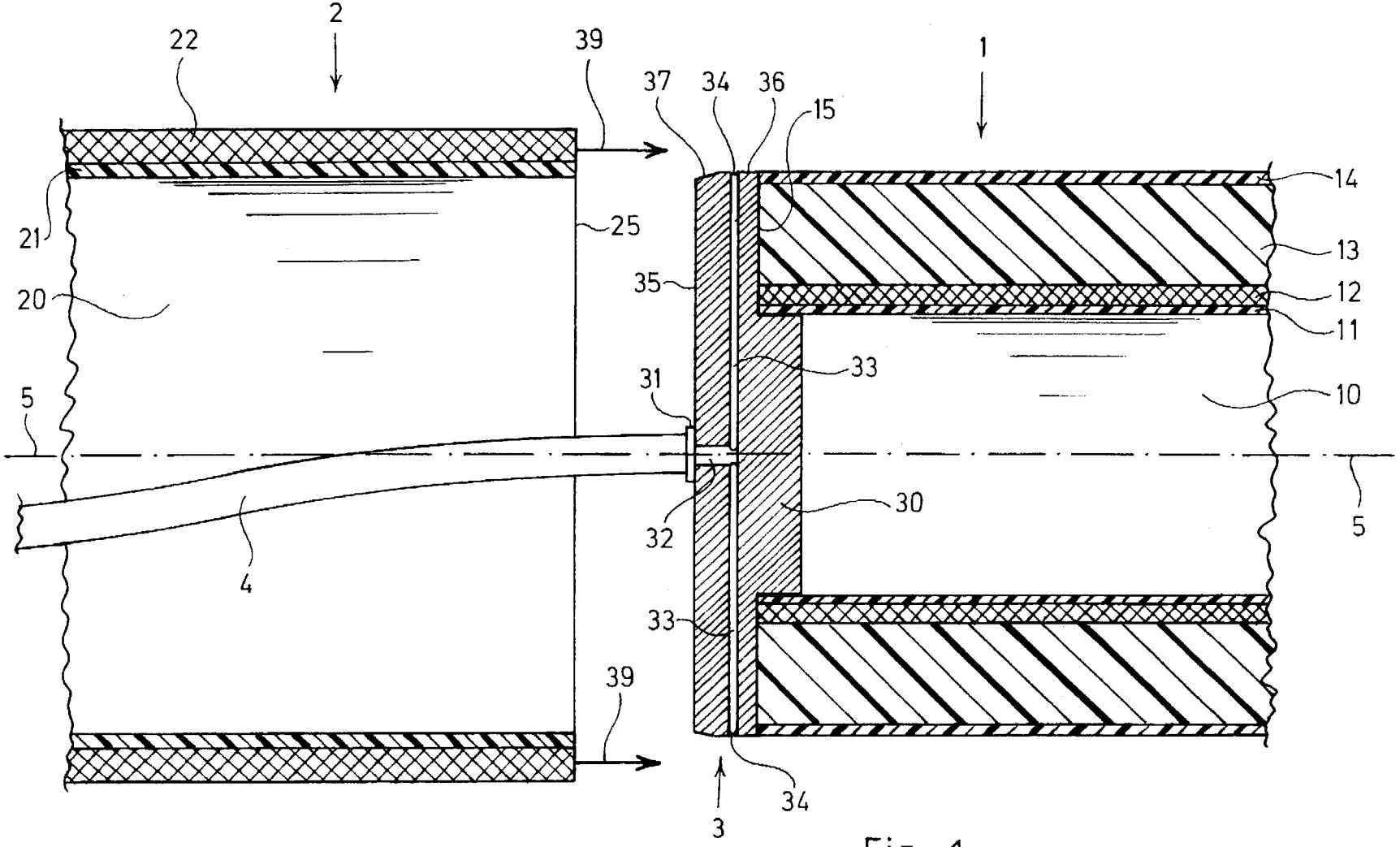
FIG. 1 is a sectional view illustrating the mounting of an outer sleeve onto an inner sleeve to form a flexo printing cylinder in accordance with the present invention.

An embodiment of a printing sleeve manufactured by a method according to the invention is furthermore explained referring to FIG. 1. FIG. 1 illustrates an inner sleeve 1 and an outer sleeve 2 prior to the fitting together to form a printing sleeve. Both sleeves 1 and 2 are shown in a longitudinal section.

In the right part of the drawing, the left end area of a hollow cylindrical inner sleeve 1 is shown, wherein in this example the inner sleeve 1 consists of four concentric layers 11, 12, 13, 14. The interior 10 of the inner sleeve 1 is hollow.

The inner first layer 11 consists of a fiber reinforced plastic material wherein the fibers may be glass fibers, carbon fibers, aramide fibers or the like. The layer 11 comprises a relatively high density and a correspondingly high strength and stiffness.

Adjacent to the first layer in radial direction outwards there is positioned the second layer 12 consisting of a flexibly compressible plastic material. The subsequent layer 13 is relatively thick in radial direction in comparison to the other three layers and consists of a plastic material of lower density, e.g. a high resistance foam. By varying the thickness of the layer 13, the outer diameter of the inner sleeve 1 may be varied in a large range with a constant inner diameter and without adding too much weight to the inner sleeve 1.

The fourth radially outer layer 14 is designed of a particularly firm polymeric material with a comparatively high density and correspondingly high strength and stiffness wherein this layer 14 selectively may be manufactured with or without reinforcement fibers.

For producing a hollow cylindrical form of the inner sleeve 1 as exact as possible, the single layers 11 to 14 preferably are produced on a master core positioned in the interior 10 of the inner sleeve 1 during production. The steps for manufacturing the separate layers are known as such and need not be explained in more detail here.

In the left part of FIG. 1, the right end area of an outer sleeve 2 is illustrated, which also is a hollow cylinder and manufactured with two layers 21, 22 in this example. The interior 20 of the outer sleeve 2 is also hollow wherein the inner diameter of the outer sleeve 2 is slightly smaller than the outer diameter of the inner sleeve 1 (i.e., in the order of the magnitude of 0.5 to 2% of the outer diameter of the inner sleeve 1).

The inner layer 21 of the outer sleeve 2 in this example consists also of a fiber reinforced plastic material and therefore has a correspondingly high strength and stiffness.

The outer layer 22 of the outer sleeve 2 is a rubber layer, which has been vulcanized onto the outer circumference of the inner layer 21 in an autoclave, using correspondingly high temperatures and pressures. The material forming the inner layer 21 of the outer sleeve 2 has to be selected so that it can withstand the temperatures and pressures during the vulcanization process without damage.

For forming the required printing sleeve, which is a printing sleeve for flexo printing in this example, the inner sleeve 1 is fitted into the outer sleeve 2 as indicated by the arrows 39. In order to fit sleeves 1 and 2 together, an air cushion or cushion of pressurized fluid is used. To produce the air cushion, an adaptor 3 is detachably attached at the left end 15 of the inner sleeve 1 as illustrated in the drawing. The adaptor 3 is symmetrical and concentric with a longitudinal center axis 5 of the inner sleeve 1. At the side thereof facing the inner sleeve 1 and positioned at the right side of the drawing, the adaptor 3 comprises a cylindrical extension 30, exactly fitting into the hollow interior 10 of the inner sleeve 1. An outer circumference 36 of the adaptor 3 comprises an outer diameter equal to the outer diameter of the inner sleeve 1. The outer circumference 36 is provided with an angled entrance side 37 at a left front side 35, facing the outer sleeve 2.

For the feeding and distribution of pressurized air for forming the required pressurized fluid or air cushion, a central passage 32 in a pocket bore concentric with the longitudinal center axis 5 is provided in the adaptor, extending from the front side 35, and with two radial passages 33, extending from the right end thereof to the outer circumference 36 and ending in air discharge openings 34. A coupling element 31 of a pressurized fluid or air hose 4 is detachably connected with the front side end of the central passage 32, with the hose 4 being guided through the interior 20 of the outer sleeve 2 and connected with a pressurized air source in a way not illustrated in FIG. 1. Of course, other fluids, preferably compressed gases may be utilized instead of pressurized air.

For the fitting together of the inner sleeve 1 and the outer sleeve 2, pressurized air is fed through the pressurized air hose 4 and through the adaptor 3 to the outer circumference 36 thereof. As soon as the outer sleeve 2 with the inner circumference area adjacent to the front end 25 thereof overlaps the air discharge openings 34 at the outer circumference 36 of the adaptor 3, an air cushion will form between those members, with the air cushion enabling a slidingly fitting together of the inner sleeve 1 and the outer sleeve 2 with little effort and friction. As soon as the inner sleeve 1 and the outer sleeve 2 are completely fitted together, the feeding of the air is terminated, whereby the air cushion discharges and the outer sleeve 2 expanded before shrinks to its original inner diameter. This leads to a firm fitting of the outer sleeve 2 and the inner sleeve 1 by frictional engagement, whereby the final printing sleeve attains mechanical features corresponding with an integrally formed member.

The adaptor 3 is removed after the fitting together of the inner sleeve 1 and the outer sleeve 2 and is not required for the operation of the final printing sleeve. The printing sleeve may then be engraved by traditional methods or laser etching methods that are known in the art.

Thereafter or usually after being transported to a printing office, the printing sleeve can be fitted onto a core roll by means of an air cushion in a known way not illustrated here and is secured on the core roll by removing the air cushion. Stripping off the complete printing sleeve from the core roll subsequently is accomplished in a known manner by means of an air cushion as well.

As is apparent from the foregoing specification, the invention is susceptible of being embodied with various alterations and modifications which may differ particularly from those which have been described in the preceding specification and description. It should be understood that such alterations and modifications fall within the spirit and scope of the present invention and that the present invention be limited solely by the hereafter appended claims.

I claim as my invention:

1. A method of manufacturing a seamless printing sleeve for mounting onto a core roll, the method comprising the following steps:

forming a cylindrical inner sleeve, the inner sleeve further including an outer surface having an outer diameter, wherein the inner sleeve comprises at least three layers including a first innermost layer, a second middle layer and a third outer layer, the first innermost layer comprises a first stiff material, the second middle layer comprises a second flexible and compressible material, the third outermost layer comprising a third stiff material, the first stiff material being different from the second flexible and compressible material, the third stiff material being different from the second flexible and compressible material, forming an outer cylindrical sleeve having at least one layer and an inner diameter, the inner diameter of the outer sleeve being smaller than the outer diameter of the inner sleeve, the outer sleeve further including an outer circumference;

attaching a rubber layer to the outer circumference of the outer sleeve;

sliding the outer sleeve onto the inner sleeve; and engraving the rubber layer.

2. The method of claim 1, further comprising the step of machining the rubber layer after the sliding step and before the engraving step.

3. The method of claim 2, wherein the machining step comprises grinding the rubber layer so that the rubber layer has a cylindrical outer circumference.

4. The method of claim 1, wherein the inner sleeve and outer sleeve are made at least partially from plastic.

5. The method of claim 1, wherein the inner sleeve comprises fiber reinforced plastic.

6. The method of claim 1, wherein the outer sleeve comprises fiber reinforced plastic.

7. The method of claim 1, wherein the engraving step comprises engraving the rubber layer using a laser engraving device.

8. The method of claim 1, wherein the first innermost layer comprises fiber reinforced plastic.

9. The method of claim 1, wherein the second middle layer comprises a flexible and compressible plastic material.

10. The method of claim 1, wherein the third outer layer comprises a polymer.

11. The method of claim 1, wherein the inner sleeve comprises a layer of foam disposed between the second and third layers.

12. The method of claim 1 further comprising the step of machining the outer surface of the inner sleeve prior to the sliding step.

13. The method of claim 1 further comprising the step of providing a supply of pressurized fluid between the inner and outer sleeves at the time of the sliding step thereby expanding the outer sleeve outward and facilitating the sliding of the outer sleeve over the inner sleeve.

14. The method of claim 13, wherein the providing step further comprises attaching an adaptor to an open end of the inner sleeve, the adaptor including an inlet for accepting pressurized fluid and an outlet for delivering pressurized fluid between the inner and outer sleeves.

15. The method of claim 14, wherein the adaptor includes an outer diameter, the outer diameter of the adaptor being substantially equal to the outer diameter of the inner sleeve.

16. The method of claim 14, further comprising the following step after the sliding step: removing the adaptor.

17. The method of claim 1, wherein the inner sleeve has a thickness ranging from about 5 mm to about 100 mm.

18. The method of claim 1, wherein the outer sleeve has a thickness ranging from about 8 mm to about 15 mm.

19. The method of claim 1, wherein the rubber layer has a thickness ranging from about 3 mm to about 10 mm.

20. A seamless printing sleeve for mounting into a core roll, the seamless printing sleeve comprising:

a cylindrical inner sleeve, the inner sleeve including an outer surface having an outer diameter, wherein the inner sleeve comprises at least three layers including a first innermost layer comprising a first rigid material, a second middle layer comprising a second flexible and compressible material and a third outer layer comprising a third rigid material, the first rigid material being different from the second flexible and compressible material, the third rigid material being different than the second flexible and compressible material, the inner sleeve being disposed within an outer cylindrical sleeve;

the outer cylindrical sleeve having at least one layer and an inner diameter, the inner diameter of the outer sleeve being smaller than the outer diameter of the inner sleeve, the outer sleeve being sufficiently elastic so that it can be expanded by air pressure and slid over the inner sleeve before the air pressure is released and the outer sleeve returns to its original inner diameter, the outer sleeve further including an outer circumference, the outer circumference of the outer sleeve accommodating a rubber layer;

the rubber layer being engraved.

21. The printing sleeve of claim 20, wherein the first innermost layer comprises fiber reinforced plastic.

22. The printing sleeve of claim 20, wherein the second middle layer comprises a flexible and compressible plastic material.

23. The printing sleeve of claim 20, wherein the third outer layer comprises a polymer.

24. The printing sleeve of claim 20, wherein inner sleeve comprises a layer of high-resistance foam disposed between the second and third layers, the layer comprises a polymer.

* * * * *